US008552874B2

(12) United States Patent
Wander

(10) Patent No.: US 8,552,874 B2
(45) Date of Patent: Oct. 8, 2013

(54) SECURITY SYSTEM FOR THE VENT STACK OF A STRUCTURE

(76) Inventor: Lloyd J. Wander, Venice, FL (US)

( * ) Notice: Subject to any disclaimer, the term of this patent is extended or adjusted under 35 U.S.C. 154(b) by 341 days.

(21) Appl. No.: 12/873,939

(22) Filed: Sep. 1, 2010

(65) Prior Publication Data

US 2011/0050434 A1 Mar. 3, 2011

Related U.S. Application Data

(60) Provisional application No. 61/238,921, filed on Sep. 1, 2009.

(51) Int. Cl.
*G08B 17/10* (2006.01)
*F24F 11/00* (2006.01)

(52) U.S. Cl.
USPC ..... 340/632; 340/693.6; 340/639.9; 454/237; 454/239

(58) Field of Classification Search
USPC ..... 340/632, 633, 634, 693.5, 693.6, 693.9, 340/693.11, 693.12; 454/237, 239, 256, 454/257; 73/1.03, 1.06, 291, 863.33; 702/24, 34, 47
See application file for complete search history.

(56) References Cited

U.S. PATENT DOCUMENTS

| | | | | |
|---|---|---|---|---|
| 3,984,826 | A * | 10/1976 | Kowalsky | 340/632 |
| 4,742,009 | A * | 5/1988 | Beverly et al. | 436/57 |
| 7,174,783 | B2 * | 2/2007 | McSheffrey et al. | 73/291 |
| 7,632,178 | B2 * | 12/2009 | Meneely, Jr. | 454/239 |
| 7,934,411 | B2 * | 5/2011 | Koch | 73/1.03 |
| 2004/0166556 | A1 * | 8/2004 | Cullimore | 435/34 |
| 2010/0105311 | A1 * | 4/2010 | Meneely, Jr. | 454/239 |

* cited by examiner

*Primary Examiner* — Van T. Trieu
(74) *Attorney, Agent, or Firm* — Gifford, Krass, Sprinkle, Anderson & Citkowski, P.C.

(57) ABSTRACT

Building vents and the associated vent stacks are an emerging security challenge. The vents may run the entire length of a building, providing a direct and substantially unobstructed path for gases and devices to be introduced into a building's interior. A security apparatus for the vent(s) of a structure may include a housing that may be positioned on a vent opening, such as a vent stack, and a gas monitoring apparatus and a motion detector. The gas monitoring apparatus may be used to detect a volatile gas in the vicinity of the housing and generate an alarm or signal when a gas is detected. The motion detector may sense the removal of the security apparatus from a vent and trigger an alarm.

19 Claims, 3 Drawing Sheets

SECURITY SYSTEM FOR THE VENT STACK OF A STRUCTURE

CROSS-REFERENCE TO RELATED APPLICATIONS

This Application claims the benefit of U.S. Provisional Application 61/238,921 filed on Sep. 1, 2009, the disclosure of which is incorporated by reference herein in its entirety.

BACKGROUND OF THE INVENTION

1. Field of the Invention

A security system is disclosed for a building vent that may have a vent stack. The system may include a housing that may be positioned proximate the vent opening, a sensor to indicate that the housing has been moved away from the vent, a sensor (s) to indicate the presence of a volatile gas that may be in the vicinity of the vent opening, and an alert signal generator.

2. Reference to Related Art

Building vents and the associated vent stacks are an emerging security challenge. The vents may run the entire length of a building, providing a direct and substantially unobstructed path to the building's interior. As a result, the potential exists for a building to be seriously damaged or destroyed through the introduction of a volatile (i.e., poisonous or explosive) gas into stacks. An explosive gas, for example, could be introduced at a lower or subterranean level of a structure and permitted to raise up though the vent(s). The gas could then be ignited at the appropriate time resulting in damage to the building. Additionally, or alternatively, an explosive gas or solid could be introduced into the vent(s) from the top and permitted to descend into the building's interior. Accordingly, it would be advantageous to have a security system that may alert a user to attempts by others to access the vent(s) and/or to the presence of a volatile gas within the vent(s).

SUMMARY OF THE INVENTION

A security apparatus that may be used with the vent stack of a structure may include a housing that may be positioned on, around or otherwise proximate the vent stack, and a gas monitoring apparatus. The housing may include a motion detector, such as an electromagnetic field generator, to detect a hazard condition such as the movement of the housing off of, or away from, the stack. The gas monitoring apparatus may be used to detect hazard condition such as the existence of a volatile gas in the vicinity of the housing and generate an alarm when the gas is detected. The alarm triggered by the gas monitoring apparatus may be a local audio alarm. Alternatively, or additionally, the apparatus may include a radio frequency transmitter or the like that transmits an alarm signal to a remote data collection point. The security apparatus, and thus the alarm signal, may also be configured to remotely or directly (i.e., hardwired) communicate with a building's internal security system.

BRIEF DESCRIPTION OF THE DRAWINGS

Reference will now be made to the attached drawings wherein like reference numerals refer to like parts throughout and wherein.

DETAILED DESCRIPTION OF A PREFERRED EMBODIMENT

Figure 1:
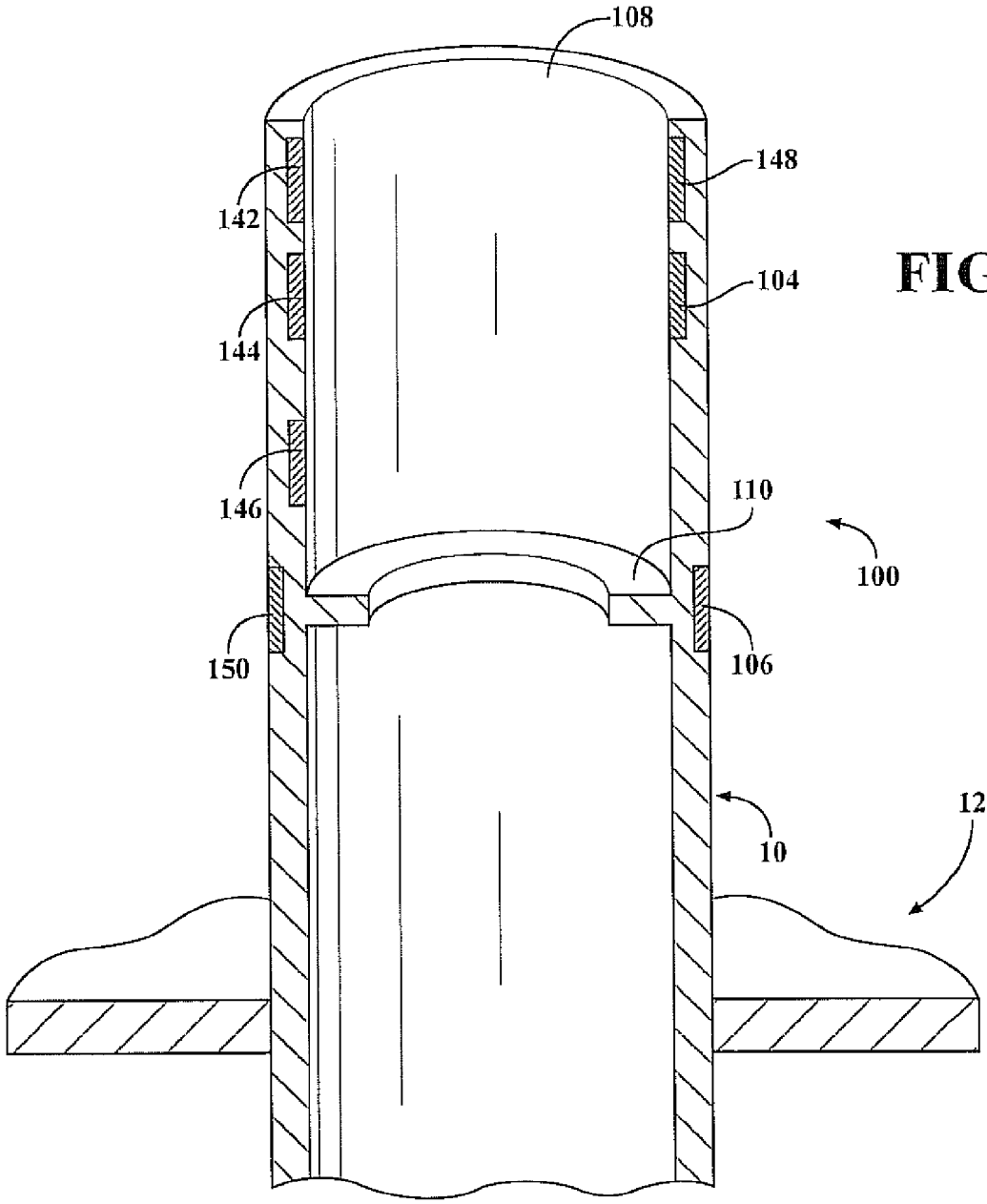
FIG. 1 is a cross sectional view of a security apparatus in positioned on a vent stack.
Figure 4A:
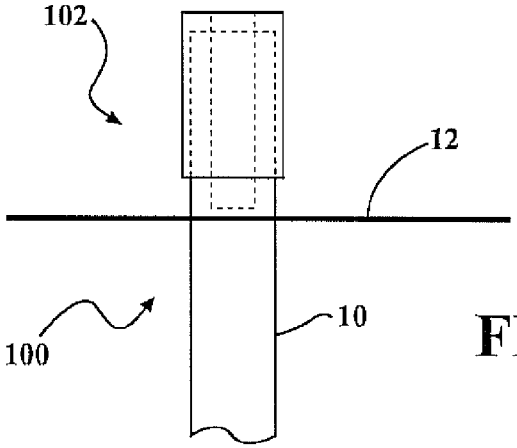
FIG. 4A are cross-sectional view of another embodiment of a security apparatus, showing the apparatus in position on the vent stack of a structure.
Figure 4B:
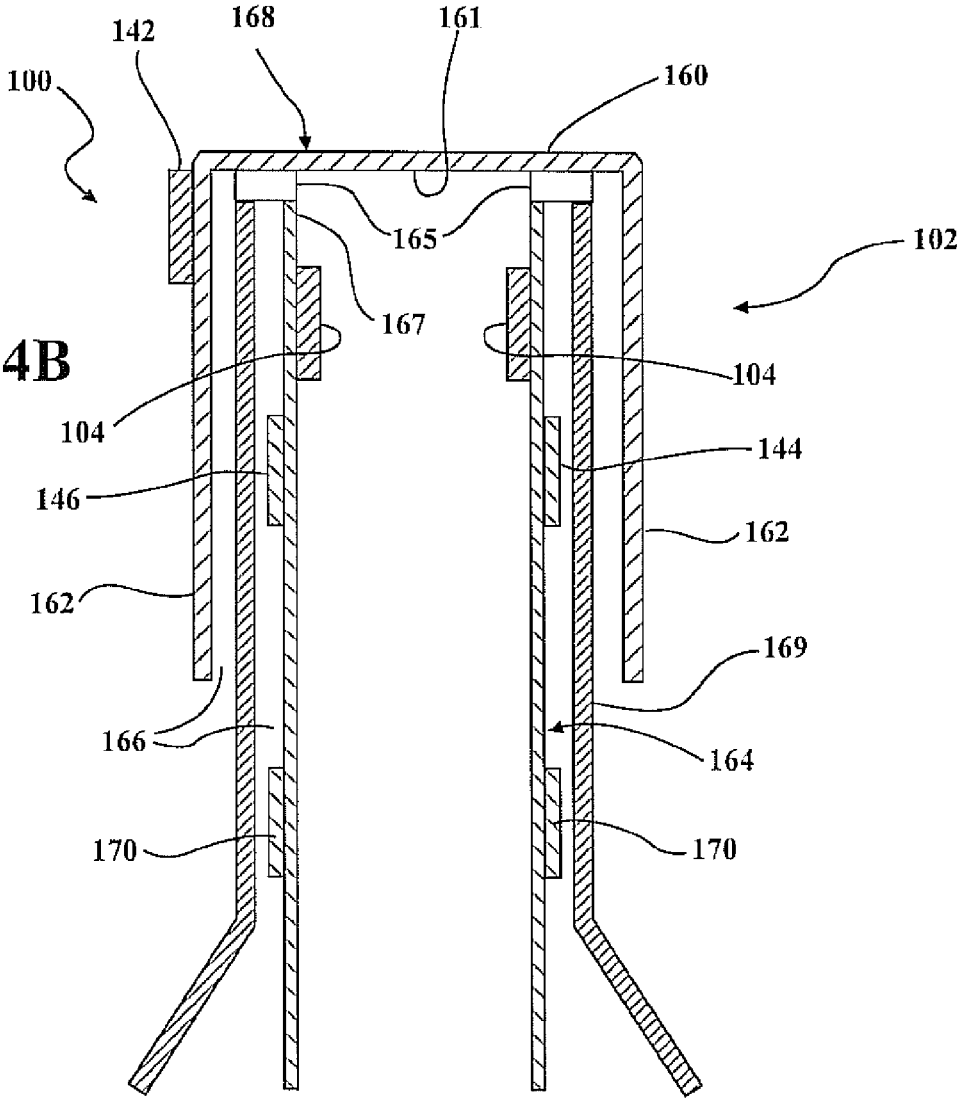
FIG. 4B is a detailed cross-sectional view of the embodiment of the security apparatus shown in FIG. 4A.

Referring now to FIGS. 1 and 4B, a security apparatus 100 for a vent of a structure, that may be positioned on a vent stack 10 of the structure 12, may include a housing 102 and a gas monitoring apparatus 104 positioned on the housing 102. The housing 102 may be formed as or with a bracket that be positioned on the stack 10. A motion detector 106, such as an electromagnetic field generator or a global positioning system receiver or transceiver, may also be positioned on the housing 102 to detect the movement of the housing 102 away from a position on the stack 10 (e.g., the removal of the housing 102 from the stack 10). The gas monitoring apparatus 104 may be used to detect a volatile gas (i.e., poisonous and/or explosive) in the vicinity (e.g., being emitted from a stack 10) and generate an alarm signal when a gas is detected. An audible alarm triggered by the signal of the gas monitoring apparatus 104 may be a local audio alarm. Alternatively, or additionally, the security apparatus 100 may include a radio frequency transmitter that may broadcast the generated alarm signal to a remote data collection point. The security apparatus 100 may also be wired or otherwise configured so that it communicates directly with the structure's 12 security system (e.g., an in-building guard station).

Still referring to FIGS. 1 and 4, the housing 102 of the security system 100 may be molded using known molding techniques and materials (such as commercially available polymer products). In one embodiment the housing 102 may be cylindrical in shape, so that it defines an interior space or passage 108 that extends though a housing 102. As shown in FIG. 1, a support flange 110 or the like may extend around and into the passage 108 and function to permit the housing 102 to be easily positioned on and around a vent stack 10. It will, however, be appreciated that the disclosure of this particular embodiment is not intended to be limiting in any way as the housing 102 may be constructed in a variety of different configurations (see e.g., FIG. 4, discussed infra).

Still referring to FIG. 1, the housing 102 may contain the components of an alarm system 140 for the security apparatus 100, including a radio frequency (RF) transmitter 142, an electromagnetic field (EMF) generator 144 and a battery 146. The EMF generator 144 affords the establishment of an electromagnetic field in relation to the stack 10 such that if and/or when the housing 102 is displaced or moved away from the stack 10 the electromagnetic field is altered. If the electromagnetic field is altered by a predetermined amount, the RF transmitter 142 may transmit an alarm signal to a distant receiver to notify a user that the housing 102 has been removed or repositioned. An audio alarm 150 can also be generated following alteration of the electromagnetic field, as may be the case if the housing 102 is moved or repositioned on (or relative to) the stack 10 but not removed.

It will be appreciated that the battery 146 affords for electrical power to the RF transmitter 142, the EMF generator 144, and the audible alarm 150. Moreover, when the battery 146 reaches a predetermined low power level, the RF transmitter 142 may transmit a low power signal to a distant receiver indicating that the battery may need maintenance or replacement. The apparatus may also be powered by a connecting to the existing power grid for the structure. Additional, or alternatively, a solar cell panel, a wind turbine or the like (not shown) may be positioned on the housing 102 or proximate the housing (e.g., on a roof of the structure 12) and electrically connected to the battery 146 for purposes of charging the battery 146 and/or powering the security apparatus 100.

Still referring to FIG. 1, the apparatus 100 may include a volatile gas sensing monitoring apparatus 104 that affords for the detection of a gas or gases (e.g., poisonous, explosive, flammable) in or exiting the stack 10 (or if there is no stack 10 the opening of a vent). The monitoring apparatus 104, for example, may include a number of "sniffer" or volatile gas sensors 148 that may take the form of sensing chips 148. Sniffer chips are known in the art and are defined as a computer chip that affords for the detection of a predetermined gas. The University of Florida has developed a number of sniffer or volatile gas chips sensitive to volatile gases such as benzene, propane, methane, natural gas and the like.

It will be appreciated that upon detection of a predetermined level of a gas by the sniffer chip(s) 148, the RF transmitter 142 (FIG. 2) may transmit a gas detection signal to a distant receiver and/or an audio alarm signal can be energized. A control circuit (not shown) can afford for communication between the RF transmitter 142, the EMF generator 144, the battery 146 and the sniffer chips 148 of the gas detecting system.

Figure 2:
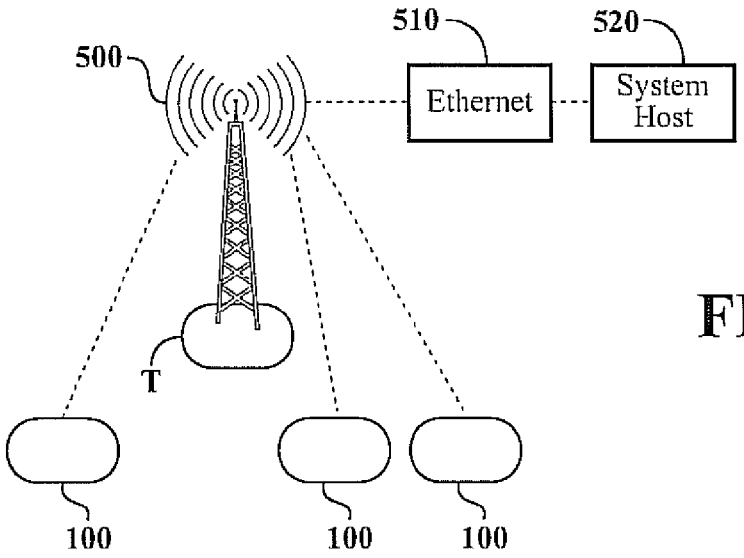
FIG. 2 is a schematic representation of an embodiment of the present invention in use with the Internet.

Turning now to FIG. 2, an embodiment of the security apparatus 100 is shown including the alarm system 148 in communication with a remote data collection device 500 that is further in communication with an Ethernet 510 and a system host 520. A useful remote data collection system for obtaining data from multiple meter devices is offered under the NETCOLLECTOR trademark, although other systems could be used as well.

Figure 3:
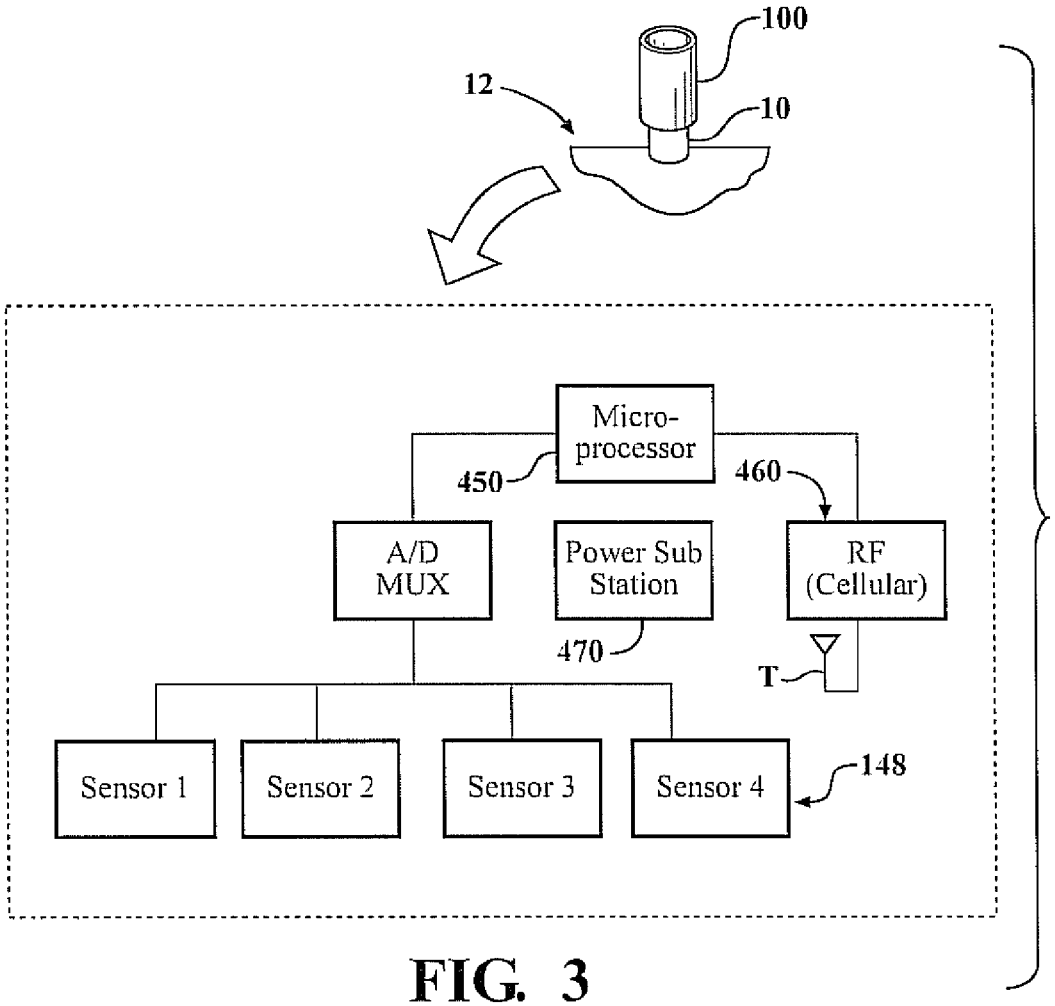
FIG. 3 is a diagrammatic representation of another embodiment of the present invention.

Referring now to FIGS. 1 and 2, the monitoring apparatus 104 may be part of a housing 102 as described above, with each monitoring apparatus 104 including a RF transmitter 142 operable to transmit a signal to the remote data collection device 500 from any of a number of apparatus 100. In some instances, the remote data collection device 500 may include a wireless, spread spectrum, frequency hopping, half duplex and/or ISM compliant remotely deployable data collection/transmission system. In addition, the monitoring apparatus 104 may use a software defined radio technology that is known to those skilled in the art. The remote data collection device 500 may connect directly to the Internet and in some instances, as illustrated in FIG. 3, may do so through the use of an Ethernet 510.

Still referring to FIGS. 1 and 2, the remote data collection device 500 may be assembled or located on a cell phone tower T, with the tower T being spaced a distance from the security apparatus 100. In some instances, the tower T may be spaced up to 1,000 feet from the security apparatus 100. In other instances, the tower T with the remote data collection device 500 thereon may be spaced greater than 1,000 feet from the apparatus 100. It is appreciated that the remote data collection device 500 on the tower T may be elevated above the ground, for example 15 feet. Wireless telephone towers may also be used as towers for this purpose.

Still referring to FIGS. 1 and 2, in operation, the EMF generator 144 may establish an electromagnetic field in relation to the stack 10 and if, or when, the housing 102 is moved from the stack 10, the electromagnetic field is altered. If the electromagnetic field is altered by a predetermined amount, the RF transmitter 142 transmits an alarm signal to the remote data collection device 500. Similarly, if a volatile gas is sensed in the stack 10 by the monitoring apparatus 104, a signal may be transmitted by the RF transmitter 142 to the remote data collection device 500.

Thereafter, once the system host 520 is logged onto the Internet, the communication linkage is established between the system host 520 and the remote data collection device 500. The alarm signal transmitted by the RF transmitter 142 to the remote data collection device 500 may then be communicated to the system host 520, thereby alerting necessary personnel that the housing 102 has been moved from the stack 10 or that a volatile gas has been detected in the stack 10. In this manner, a security system apparatus 100 is provided wherein the removal of a housing 102 from the stack 10 and/or the presence of a dangerous gas in the stack 10 can be determined from a remote location.

Referring now to FIG. 3, there is shown a diagrammatic representation of an embodiment of the security apparatus 100, including a representation of the housing 102 for the apparatus positioned on a stack 10 of a structure 12. As shown, the housing 102 may include sensors 148 designated here as Sensor 1, Sensor 2, Sensor 3, Sensor 4. Sensors 1, 2 and 3 may detect volatile gases. When a dangerous gas is detected as being within or near the stack 10, the sensors (1-3) may function to detect the gas and transmit a signal to a controller (e.g., microprocessor 450). Sensor 4 may be a motion detector that may function to transmit a signal to the controller following detection by the sensor 4 of a predetermined level of motion to the housing 102. Information transmitted to the controller by the sensors (1-4) may then be transmitted to a remote location by way of RF cellular network 500, a cellular tower T or a wired connection. A power supply 450 may also be included to provide power for the sensors (1-4), controller, etc.

Referring now to FIGS. 4A and 4B there is shown another embodiment of the security apparatus 100 in which the housing 102 may include a base 160 portion having an exterior 162 wall and an interior 164 wall that each extend from one side or floor 161 of the base 160. More specifically, the base 160 may include a plurality of spacers 165 that extend from the floor 161 of the base 160 and function to support the apparatus 100 on the vent stack 12. The end 167 of the interior wall 164 proximate the floor 161 of the base 160 may be mounted on the spacers 165. The base 160 and walls 162 may define a channel 166 that may function to allows the housing 102 to be fitted down and around the opening of a vent or vent stack 10. More particularly, the housing 102 shown in FIG. 4 may be fitted to the stack 12 such that the apparatus 100 is supported by the spacers 165 of the interior wall 164, the base 160 resting above the top the stack 12, the exterior wall 162 extending around an exterior 169 of the stack 12, and the interior wall 164 functioning as a probe for the housing 102 that may extend into the stack 12. Gas may exit the vent stack 12 and pass through the housing 102 by virtue of one or more openings (not shown) defined in the base 160 and/or by descending downward at exiting the channel around the rim of the exterior wall. Thus, it will be appreciated that housing 102 of FIG. 4 may be constructed to have a generally cylindrical shape so that it may be easily positioned on the stack 12. However, the housing 102 may be also constructed to have another shape predetermined by the user (i.e., square, oval, etc.).

Still referring to FIG. 4, the length of the interior wall 164 may be predetermined by the user. However, as shown, the interior wall 164 may be dimensioned longer than the exterior wall 162 so that in operation any sensors positioned in the interior wall 164, such as a gas monitoring apparatus 104, are positioned far enough into the stack 12 to mitigate against the erroneous detection of gas(es) exterior to the stack 12. A radio frequency (RF) transmitter 142, an electromagnetic field (EMF) generator 144, a battery 146 and the like may also be positioned in (or molded integral with) the interior wall 164 (or alternatively the exterior wall 162 or base 160).

Having thus described my invention, various other improvements will become known to those of skill in the art that do not depart from the spirit or scope of the present invention.

I claim:

1. A security apparatus comprising:

a housing operable to be positioned on a vent stack of structure, the housing having a motion detector operable to detect movement of the housing away from a position on the vent stack; and a gas monitoring apparatus positioned on the housing, the gas monitoring apparatus being operable to detect a volatile gas in the vicinity of the housing and generate an alarm signal when a volatile gas is detected.

2. The security apparatus of claim 1, further comprising a radio frequency transmitter in electronic communication with the gas monitoring apparatus and operable to transmit the alarm signal to a remote data collection point.

3. The security apparatus of claim 1, wherein the motion detector comprises an electromagnetic field generator.

4. The security apparatus of claim 1, wherein the apparatus further comprises an audio alert broadcasting device in electronic communication with the gas monitoring apparatus and operable to transmit an audible alarm in response to the alarm signal.

5. The security apparatus of claim 1, wherein the housing comprises a base having a first wall and a second wall, the first wall extending from a perimeter of the base and from one side of the base, and the second wall extending from the one side of the base interior to and spaced apart from the first wall to form a channel defined by the walls and the one side of the base, and the gas monitoring apparatus being positioned on at least one of the first wall or the second wall, and the housing operating to be fitted to a stack of a vent such that the base rests atop the stack the first wall extends exterior to an outer surface of the stack, and the second wall extends into the stack.

6. The security apparatus of claim 5, wherein the second wall extends a length that is greater than a length of the first wall.

7. The security apparatus of claim 6, wherein the base is circular, the first wall extends around the entire perimeter of the base, and the second wall is concentric to the first wall.

8. The security apparatus of claim 7, wherein the second wall defines at least one opening operating to permit a gas to flow between an interior portion of the wall and the channel.

9. The security apparatus of claim 8, further comprising a radio frequency transmitter in electronic communication with the gas monitoring apparatus and operable to transmit the alarm signal to a remote data collection point.

10. The security apparatus of claim 8, wherein the housing further comprises a motion detector operable to detect movement of the housing away from a position on the vent stack.

11. The security apparatus of claim 10, wherein the motion detector comprises an global positioning system receiver.

12. A method of securing vent stack comprising:

providing structure having a vent stack;

providing a security apparatus including a housing, a sensor mounted on the housing, and an alarm signal generator;

positioning the security apparatus on the vent stack so that the sensor is positioned proximate an opening of the stack;

detecting by the sensor of a hazard condition;

transmitting an alarm signal by the alarm signal generator following the detection of a hazard condition by the sensor.

13. The method of claim 12, wherein the sensor comprises a gas monitoring apparatus positioned on the housing, the gas monitoring apparatus operating to transmit a signal to the alarm signal generator when a volatile gas is detected, and the hazard condition being the detection by the gas monitoring apparatus of a predetermined volatile gas.

14. The method of claim 12, wherein the sensor comprises a motion detector positioned on the housing, the motion detector operating to transmit a signal to the alarm signal generator when the housing is moved relative to the vent stack, and the hazard condition being detected by the motion detector of a predetermined level of movement of the housing.

15. The method of claim 14, wherein the motion detector comprises an electromagnetic field generator.

16. The method of claim 12, wherein the alarm signal generator comprises a radio transmitter in electronic communication with the sensor and operable to transmit the alarm signal to a remote data collection point.

17. The method of claim 12, wherein the alarm signal generator comprises an audible alarm and the transmission of an alarm signal includes the emission of an audible alarm tone.

18. A security apparatus for the vent stack of a structure comprising:

a housing including a bracket and a probe portion, the bracket operating to removably mount the housing to a vent stack of a structure, and the probe portion being configured to extend into an interior of the vent stack when the housing is mounted to the stack;

a gas monitoring apparatus positioned on the probe portion of the housing and operating to detect a volatile gas in the vicinity of the housing;

a motion detector positioned on the housing and operating to detect movement of the housing relative to a vent stack; and a radio frequency transmitter in electronic communication with the gas monitoring apparatus and motion detector and operating to transmit the alarm signal to a remote data collection point.

19. The security apparatus of claim 18, wherein the apparatus further comprises an audio alert broadcasting device in electronic communication with the gas monitoring apparatus and motion detector and operating to transmit an audible alarm in response to a signal from at least one of the gas monitoring apparatus or motion detector.

* * * * *